US006837683B2

(12) United States Patent
Dailey

(10) Patent No.: US 6,837,683 B2
(45) Date of Patent: Jan. 4, 2005

(54) GAS TURBINE ENGINE AEROFOIL

(75) Inventor: Geoffrey M Dailey, Derby (GB)

(73) Assignee: Rolls-Royce plc, London (GB)

( * ) Notice: Subject to any disclaimer, the term of this patent is extended or adjusted under 35 U.S.C. 154(b) by 30 days.

(21) Appl. No.: 10/291,408

(22) Filed: Nov. 12, 2002

(65) Prior Publication Data

US 2003/0133797 A1 Jul. 17, 2003

(30) Foreign Application Priority Data

Nov. 21, 2001 (GB) ..... 0127902

(51) Int. Cl.[7] ..... F01D 5/08
(52) U.S. Cl. ..... 416/97 R; 415/172 A
(58) Field of Search ..... 416/97 R, 97 A, 416/96 A, 96 R, 92, 90 R, 231–233, 95; 415/172–173, 115, 172 A, 172.1

(56) References Cited

U.S. PATENT DOCUMENTS 3,732,031 A * 5/1973 Bowling et al. ..... 416/97 R
5,246,340 A 9/1993 Winstanley
5,667,359 A * 9/1997 Huber et al. ..... 416/96 A
5,720,431 A 2/1998 Sellers

FOREIGN PATENT DOCUMENTS

| | | |
|---|---|---|
| EP | 0230917 A | 8/1987 |
| EP | 1126135 A | 8/2001 |
| GB | 2112868 A | 7/1983 |
| GB | 2349920 A | 11/2000 |

* cited by examiner

*Primary Examiner*—Edward K. Look
*Assistant Examiner*—James M. McAleenan
(74) *Attorney, Agent, or Firm*—W. Warren Taltavull; Manelli, Denison & Selter, PLLC

(57) ABSTRACT

A gas turbine engine blade or vane comprises inner linked chambers. A chamber adjacent the leading edge is provided with an inlet for receiving cooling fluid and a chamber adjacent the trailing edge is provided with an outlet for exhausting cooling fluid. The chambers are arranged in series from the leading edge to the trailing edge so as to direct cooling fluid within the aerofoil blade or vane from the leading edge region to the trailing edge region.

5 Claims, 3 Drawing Sheets

GAS TURBINE ENGINE AEROFOIL

FIELD OF THE INVENTION

This invention relates to aerofoil blades or vanes for gas turbine engines. More particularly this invention relates to the cooling of gas turbine blades or vanes.

A BACKGROUND OF THE INVENTION

In a gas turbine engine hot combustion gases flow from a combustion chamber through one or more turbines which extract energy from these gases and provide power for one or more compressors and output power. Turbine blades and vanes are required to operate in extremely high temperatures and require efficient cooling if they are to withstand such temperatures.

Such cooling typically takes the form of passages formed within the blades or vanes which are supplied in operation with pressurised cooling air derived from a compressor of the gas turbine engine. This cooling air is directed through the passages in the blades or vane to provide convective or impingement cooling of the blade or vanes before being exhausted into the hot gas flow in which the blade or vane is operationally situated.

The cooling air may also be directed through small holes provided in the aerofoil surface of the blade or vane in order to provide so-called "film cooling" of the aerofoil surface.

It is known to provide hollow vanes or blades with an inner aerofoil shaped "tube" through which cooling air is passed. The inner tube is formed with holes to direct its cooling air outwardly on to the internal surfaces of the vane or blade. However, the provision of such an inner tube adds weight to the blade or vane.

SUMMARY OF THE INVENTION

According to the present invention there is provided an aerofoil blade or vane for a gas turbine engine comprising inner chambers at least one of said chambers adjacent the leading edge of said blade or vane being provided with a cooling fluid inlet and at least one other chamber adjacent said trailing edge being provided with a cooling fluid outlet the inner chambers having passageways linking one chamber to an adjacent chamber and the chambers being arranged in series from the leading edge to the trailing edge of the aerofoil blade or vane such that cooling fluid flow may be directed within the aerofoil from the leading edge region to the trailing edge region of the aerofoil.

Preferably the chambers are sized so as to provide a predetermined pressure drop between successive chambers.

Alternatively or in addition said passageways may be sized so as to provide a predetermined pressure drop from one chamber to an adjacent chamber.

Preferably said passageways are angled to direct cooling fluid passing from one chamber to an adjacent chamber on to the internal walls of the adjacent chamber so as to provide impingement cooling thereof.

Preferably apertures are provided in the walls of the blade or vane to allow a proportion of the cooling fluid to exhaust from one or more of said chambers.

Cooling air is preferably provided from the compressor of the gas turbine engine.

BRIEF DESCRIPTION OF THE DRAWINGS

An embodiment of the invention will now be described by way of example only with reference to the accompanying drawings in which.

DETAILED DESCRIPTION OF THE INVENTION

Figure 1:
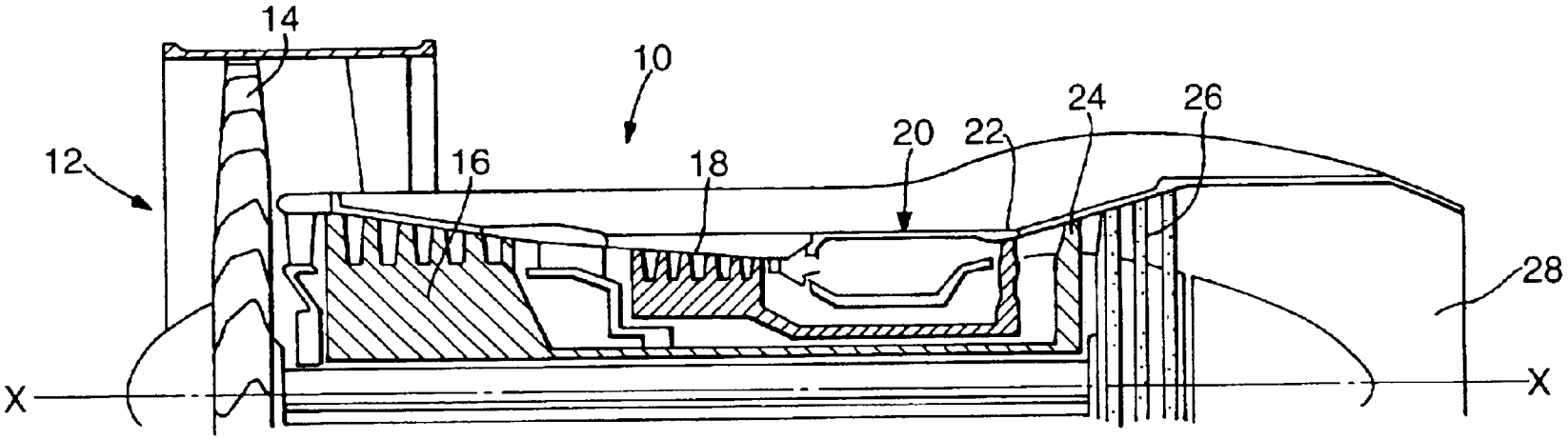
FIG. 1 is a diagrammatic cross-section through part of a ducted fan gas turbine engine.

With reference to FIG. 1, a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in a conventional manner so that air entering the intake is accelerated by the fan to produce two air flows, a first air flow into the intermediate pressure compressor 16 and a second air flow which provides propulsive thrust. The intermediate pressure compressor 16 compresses the air flow directed into it before delivering air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2:
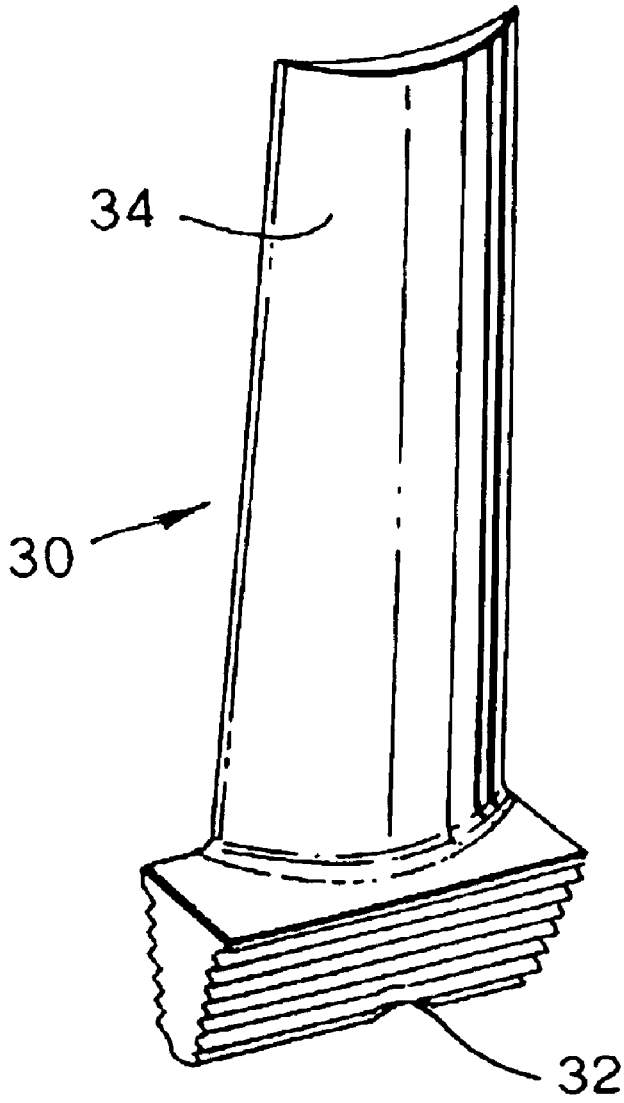
FIG. 2 is a perspective view of a cooled aerofoil blade in accordance with the present invention.
Figure 3:
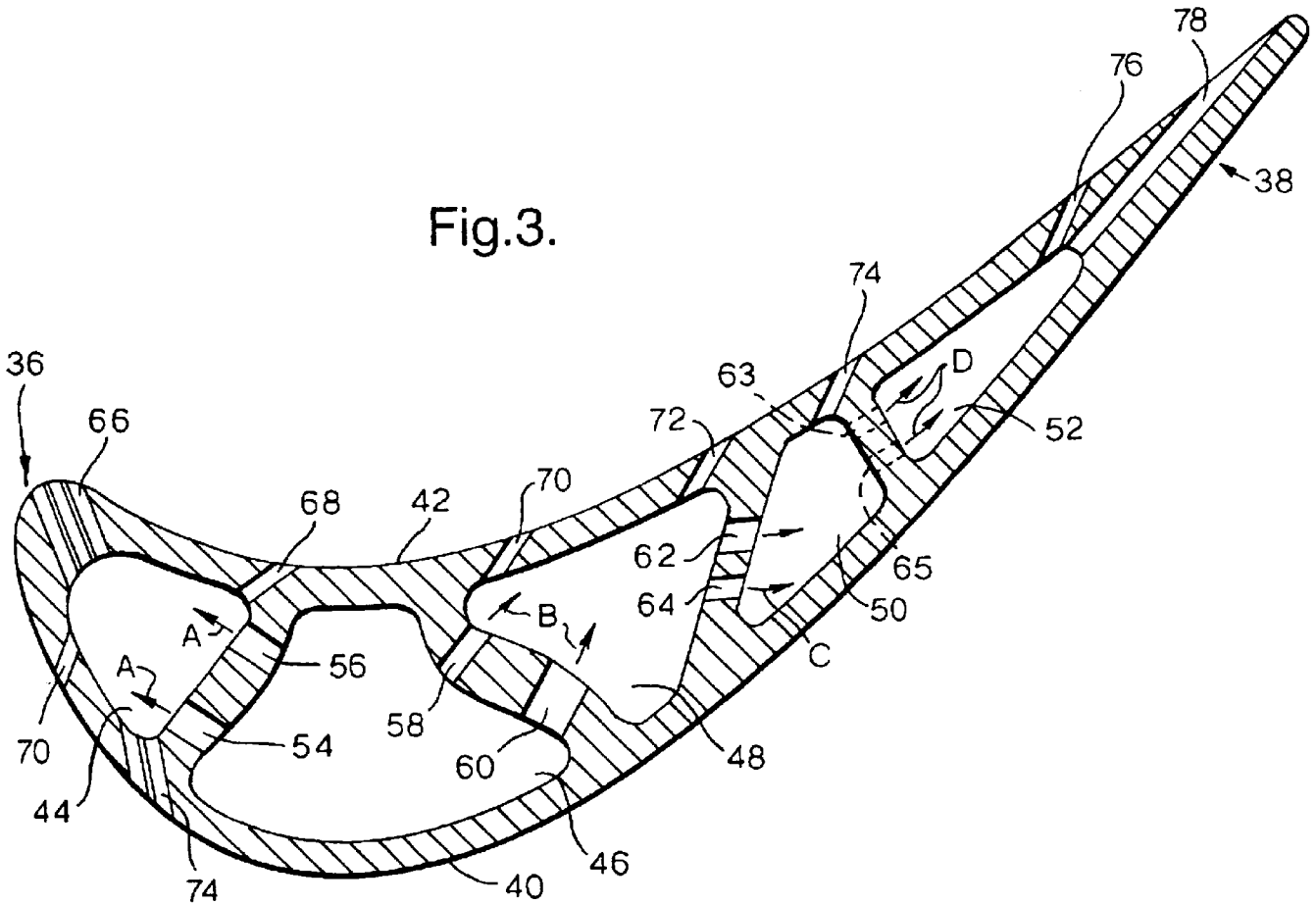
FIG. 3 is a cross section through the aerofoil portion of the cooled aerofoil blade shown in FIG. 2.

The high pressure turbine 22 includes an annular array of cooled aerofoil blades which can take several forms, one of which 30 is shown in FIG. 2. The aerofoil blade 30 comprises a root portion 32 and an aerofoil portion 34. The root portion 32 is of fir tree shaped cross-section for engagement in a correspondingly shaped recess in the periphery of a rotary disc (not shown). The cross-section of the aerofoil portion 34 can be seen more clearly in FIG. 3 and includes a leading edge region 36 and trailing edge region 38. The aerofoil 30 includes a suction side wall 40 and a pressure side wall 42. The suction side wall 40 is generally convex and the pressure side wall is generally concave. The side walls are joined together at the leading and trailing edges 36, 38 which extend from the root 32 at the blade platform to the outer tip 44.

The aerofoil portion 30 is divided by internal partitions into a series of chambers 44, 46, 48, 50 and 52 each of which extend along substantially the whole length of the aerofoil and are adjacent one another from the leading edge 36 to the trailing edge 38 of the aerofoil.

The chamber 46 is provided with an inlet opening (not shown) at its radially inner end such that it may receive a supply of cooling air. The remaining chambers 44, 48, 50 and 52 are, in the embodiment shown, closed at their radially outer and inner ends, but in other embodiments, the chambers 44, 48, 50 and 52 may be open at their radially inner and outer ends. Passageways 54, 56, 58, 60, 62 and 64 extending through the partitions link the chambers 44, 46, 48 and 50. Chamber 50 is also linked to chamber 52, and the passageways 63, 65 which link these two chambers 50, 52 are shown in dashed lines in the cross-sectional view of FIG. 3, because they are provided at a different radial height from the other passageways. The linking of the chambers allows the cooling air to be directed from one chamber to another thus cooling successive portions of the blade or vane in turn.

The passageways 54, 56, 58, 60, 62 and 64 are angled so as to direct cooling air onto the internal surfaces of the aerofoil at locations where cooling is most required. The radial length of the chambers 44, 46, 48, 50 and 52 may be varied according to cooling requirements within the aerofoil. For example when parts of the aerofoil do not require impingement cooling then the chamber may be arranged to extend only to those parts of the aerofoil which require impingement cooling.

Film cooling holes 66, 68 70 and 74 are provided in the portion of the walls 40 and 42 defining the chamber 44 to exhaust cooling air from within the chamber to provide film cooling along the suction side 40 and the pressure side 42 of the blade. Additional film cooling holes 70 and 72 are provided to exhaust some of the cooling air from within the chamber 48. The remainder of the cooling air directed into the chamber 48 flows through the passageways 62 and 64 into the chamber 50. The chamber 50 is also provided with the an exhaust film cooling hole 74 which again provides an exit for some of the cooling air within chamber 50 to provide film cooling. Finally the chamber 52 adjacent the trailing edge 38 of the aerofoil is also provided with exhaust passageways 76 and 78 which direct cooling air along the trailing edge portion of the aerofoil 34 to provide further film cooling.

In use, cooling air from the compressor is fed into the chamber 46 to provide impingement cooling of the internal surfaces of the suction and pressure sides 40, 42 of the blade. This cooling air is then fed through passageways 54, 56, as indicated by the arrows A, into the chambers 44 and 48 to provide impingement cooling of the internal surfaces of the suction and pressure sides 40, 42. Thereafter the air from chamber 48 is directed into the chamber 50 via passageways 62 and 64, as indicated by the arrows C to provide impingement cooling of the internal surfaces of the suction and pressure sides of the blade in these regions. Similarly, air enters the chamber 52 via the passageways 63, 65, as indicated by the arrows D.

Thus all of the cooling air is utilised efficiently by passing it through a number of chambers to provide impingement cooling of the internal surfaces of successive sections of the aerofoil.

The cooling air flowing into the aerofoil into chamber 46 is utilised more than once and the pressure drop between the chambers is utilised by the cooling air to assist in its flow from the leading edge to the trailing edge portion of the aerofoil.

The size of the chambers and the passageways may be designed to suit the cooling requirements of the aerofoils. For example by altering the size or shape of the chambers, the pressure drops between each chamber can be adjusted to suit the cooling requirements of the aerofoil. For example when a higher pressure cooling air supply is required in one chamber the passageway linking that chamber to a previous chamber may be widened. If the pressure drop between two adjacent chambers is required to be relatively low, for example if the cooling air needs only to pass from one chamber to another at a relatively slow speed, then the chamber sizes may be designed to be similar.

The chambers may be manufactured using soluble core technology which allows the chambers to be formed from a solid aerofoil without the need for an additional chamber to be inserted with a hollow aerofoil as in previously proposed aerofoil cooling arrangements. This allows the aerofoil to be lighter and hence provides improved engine efficiency.

The available overall pressure drop across the blade 30 is utilised in multiple stages each stage having a more modest pressure drop than would be employed by a single overall impingement stage. This reduced pressure drop across each stage may be offset by providing larger passageways or an increased number of linking passageways such that the impingement cooling effect is retained at a desired pressure.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An aerofoil having leading and trailing edges for a gas turbine engine comprising inner chambers, at least one of said chambers adjacent said leading edge of said aerofoil being provided with a cooling fluid inlet and at least one other chamber adjacent said trailing edge being provided with a cooling fluid outlet, the inner chambers having passageways linking one chamber to an adjacent chamber and the chambers being arranged in series from the leading edge to the trailing edge of the aerofoil such that cooling fluid flow is directed within the aerofoil from the leading edge region to the trailing edge region of the aerofoil and each said chamber having an internal wall and wherein the passageways are angled to direct the cooling air from one chamber to an adjacent chamber on to said internal wall of the adjacent chamber so as to provide impingement cooling thereof and to provide cooling air to successive sections of the internal surfaces of the aerofoil suction and pressure surfaces.

2. An aerofoil as claimed in claim 1 wherein said chambers are sized so as to provide a predetermined pressure drop to an adjacent chamber.

3. An aerofoil as claimed in claim 1 wherein said passageways are shaped so as to provide a predetermined pressure drop from one chamber to an adjacent chamber.

4. An aerofoil as claimed in claim 1 wherein holes are provided in the walls of the aerofoil so as to allow a portion of the cooling air to exhaust from said chambers.

5. An aerofoil as claimed in claim 1 wherein said cooling air is derived from the compressor of the gas turbine engine.

* * * * *